US005798468A

United States Patent [19]

Weise et al.

[11] Patent Number: 5,798,468

[45] Date of Patent: Aug. 25, 1998

[54] SINTERING MATERIAL CONTAINING SILVER-TIN OXIDE FOR ELECTRICAL CONTACTS AND PROCESS FOR ITS MANUFACTURE

[75] Inventors: Wolfgang Weise, Frankfurt; Roger Wolmer, Hanau; Peter Braumann, Alzenau, all of Germany

[73] Assignee: Degussa Aktiengesellschaft, Frankfurt am Main, Germany

[21] Appl. No.: 594,143

[22] Filed: Jan. 31, 1996

[30] Foreign Application Priority Data

Feb. 1, 1995 [DE] Germany ..... 195 03 182.2

[51] Int. Cl.[6] ..... B22F 3/20; C22C 1/05; C22C 5/06

[52] U.S. Cl. ..... 75/232; 75/234; 75/247; 419/3; 419/21; 419/28; 419/29; 419/31; 419/32; 419/38; 419/47

[58] Field of Search ..... 419/3, 21, 28, 419/29, 38, 47, 31, 32; 75/232, 234, 247

[56] References Cited

U.S. PATENT DOCUMENTS

| | | | |
|---|---|---|---|
| 4,141,727 | 2/1979 | Shida et al. | 75/232 |
| 4,396,420 | 8/1983 | Schmidberger et al. | 75/0.5 AC |
| 4,551,301 | 11/1985 | Schreiner et al. | 419/21 |
| 4,565,590 | 1/1986 | Grosse et al. | 148/431 |
| 4,609,525 | 9/1986 | Schreiner et al. | 419/6 |
| 4,680,162 | 7/1987 | Shibata | 419/21 |
| 4,681,702 | 7/1987 | Schreiner et al. | 252/518 |
| 4,695,330 | 9/1987 | Shibata | 148/6.3 |
| 4,764,227 | 8/1988 | Rothkegel et al. | 148/431 |
| 4,817,695 | 4/1989 | Wingert et al. | 148/431 |
| 4,855,104 | 8/1989 | Rothkegel et al. | 419/28 |
| 4,980,125 | 12/1990 | Haufe et al. | 419/21 |
| 5,160,366 | 11/1992 | Shibata | 75/232 |

FOREIGN PATENT DOCUMENTS

| | | |
|---|---|---|
| 2428147 | 2/1975 | Germany . |
| 2754335 | 6/1978 | Germany . |
| 2952128 | 6/1981 | Germany . |
| 3538684 | 5/1986 | Germany . |
| 4319137 | 12/1993 | Germany . |
| 4331526 | 3/1994 | Germany . |

OTHER PUBLICATIONS

Investigation Into the Switching Behaviour of New Silver–Tin Oxide Contact Materials, Herz et al., Process of the 14th Int. Conf. on El. Contacts, Paris, 1988, Jun. 20–24, pp. 405–409.

Etz. Bd. 112 (1991), H. 22, Braumann et al., pp. 1210–1215.

*Primary Examiner*—Daniel J. Jenkins

*Attorney, Agent, or Firm*—Beveridge, DeGrandi, Weilacher & Young, L.L.P.

[57] ABSTRACT

An electrical contact material for switching rated currents between 20 and 100 Ampere having improved operational life made of 3.2 to 19.9 wt-% tin oxide and 0.05 to 0.4 wt-%, in each case, of indium oxide and bismuth oxide, the remainder being silver. In the course of the manufacture of the material by powder metallurgy more than 60 wt-% of the tin oxide should exhibit a particle size of more than 1 μm.

8 Claims, No Drawings

SINTERING MATERIAL CONTAINING SILVER-TIN OXIDE FOR ELECTRICAL CONTACTS AND PROCESS FOR ITS MANUFACTURE

INFORMATION AND BACKGROUND

The present invention relates to a sintering material manufactured by powder metallurgy containing silver-tin oxide with added amounts of indium oxide and bismuth oxide for electrical contacts which are used for switching rated currents between 20 and 100 Ampere and also to a process for manufacture thereof.

Silver/metal and silver/metal-oxide composite materials have proved useful for the manufacture of electrical contacts in low-voltage switching devices. By way of example, silver/metal composite material most frequently used is made of silver/nickel, the main field of application of which relates to relatively low currents. In the case of high currents, up until a few years ago use was made almost exclusively of silver-cadmium oxide. Due to environmental pollution, however, attempts have increasingly been made to replace the cadmium oxide with other oxides. Meanwhile, tin oxide has gained acceptance in many fields as an alternative to cadmium oxide.

By virtue of the higher thermal stability of tin oxide, the silver-tin-oxide composite material displays a clearly reduced burn-off rate in comparison with silver-cadmium oxide, resulting in a longer operational life in the switching device. The disadvantage of $AgSnO_2$ is that it has a tendency to form a covering layer and consequently tends to give rise to greater heating effects in the switching devices. By means of certain additives such as $WO_3$ or $MoO_3$ it has been possible to cope with this problem. These materials have proved outstandingly valuable in the case of switching devices that need to withstand high thermal loads. $AgSnO_2$ with these additives has proved particularly effective in switching devices with rated currents of more than 100 Amp and under so-called AC4 loading, though in the case of lower switching currents the operational life of these materials is relatively short.

The $AgSno_2WO_3/MoO_3$ material is manufactured by powder metallurgy using extrusion technology. Manufacture by powder metallurgy has the advantage that use can be made of additives of any type and in any quantity. Hence the material can be optimized selectively with a view to achieving particular properties such as welding strength or degree of heating. In addition, the combination of powder metallurgy with extrusion technology permits a particularly high degree of economy in the production of the contact pieces.

An internally oxidized $AgSnO_2/In_2O_3$ material also finds application. This material, which is described in De-OS 24 28 147, contains, besides 5–10% $SnO_2$, also 1–6% $In_2O_3$. However, internally oxidized materials have the disadvantage that the additives have to be selected with due regard to the oxidation kinetics of the materials. A selective change in the concentrations of the oxide additives in order to influence particular switching properties is frequently not possible by reason of the oxidation kinetics. However, the $AgSnO_2/In_2O_3$ has the disadvantage that it results in high excess temperatures in the course of switching.

In DE-OS 27 54 335 a contact material is described which besides silver contains 1.6 to 6.5 $Bi_2O_3$ and 0.1 to 7.5 $SnO_2$. This material can be manufactured both by means of internal oxidation and also by powder metallurgy. However, such high contents of $Bi_2O_3$ result in embrittlement, so that the material can only be manufactured by individual sintering and not by means or the more economic extrusion technology.

From U.S. Pat. No. 4,680,162 an internally oxidized $AgSnO_2$ material is known which in the case of tin contents of more than 4.5 % may contain additions of 0.1–5 indium and 0.01–5 bismuth. The metal-alloy powder is compacted and then internally oxidized. By means of these additives the inhomogeneous oxide precipitations that are customary in the course of internal oxidation are prevented. However, this material does not display optimal contact properties.

The publication "Investigation into the Switching Behavior of new Silver-Tin-Oxide Contact Materials", in Proc. of the 14th Int. Conf. on El. Contacts, Paris 1988, Jun. 20–24, pages 405–409 gives an account of the switching behavior of electrical contacts made of silver-tin oxide and manufactured by powder metallurgy which may contain two additional oxides selected from the group consisting of bismuth oxide, indium oxide, copper oxide, molybdenum oxide and tungsten oxide, there being no statement regarding the precise composition of these materials.

In U.S. Pat. No. 4,695,330 a special process is described for the manufacture of an internally oxidized material with 0.5–12 tin, 0.5–15 indium and 0.01–1.5 bismuth. However, this process is very cost intensive.

The manufacture by powder metallurgy of contact materials on the basis of silver-tin oxide by mixing of the powders, cold isostatic pressing, sintering and extrusion so as to form a semi-finished product is known from, for example, DE-OS 43 19 137 and DE-OS 43 31 526.

From U.S. Pat. No. 4,141,727 contact materials made from silver are known which contain bismuth-tin oxide by way of mixed-oxide powder. In addition, in DE-PS 29 52 128 the tin-oxide powder is annealed prior to being mixed with the silver powder at 900 to 1600° C.

In medium current ranges from 20 to 100 Amp none of the known $AgSnO_2$ materials have hitherto been able to replace the toxic material AgCdO entirely, since in this field of application AgCdO exhibits a very good switching lifetime that has not quite been achievable by $AgSnO_2$.

SUMMARY TO THE INVENTION

An object of the present invention was therefore to develop a sintering material manufactured by powder metallurgy on the basis of silver-tin oxide with added amounts of indium oxide and bismuth oxide for electrical contacts, said material displaying a welding tendency that is as low as possible and excess temperatures that are as low as possible in the course of switching rated currents between 20 and 100 Ampere and, in the case of AC3 loading in switching devices, having an operational life which is similar to that of silver-cadmium oxide. In addition, a process for the manufacture of said sintering material was to be found that is economical and brings about further improvements in the material.

These and other objects are achieved in accordance with the invention in a sintering material that comprises 3.2 to 19.9 wt-% tin oxide, 0.05 to 0.4 wt-%, in each case, of indium oxide and bismuth oxide, the remainder being silver.

In the current range from 20 to 100 Ampere this material displays an outstanding operational life with excess temperatures lying clearly below 100° C.

Particularly good material properties are achieved in the course of manufacture of the material by mixing of the powders, cold isostatic pressing of the powder mixture, sintering at temperatures from 500 ° to 940° C. and extrusion so as to form wires or profiles if more than 60 wt-% of the tin-oxide powder employed exhibits a particle size of more than 1 μm prior to the mixing with the silver powder and the other oxide powders.

It has proved particularly useful to react the bismuth oxide, prior to the mixing with the silver powder and the indium-oxide powder, with the tin-oxide powder so as to form the mixed-oxide powder $Bi_2Sn_2O_7$, which should also exhibit a particle size of more than 1 μm in a proportion amounting to more than 60 wt-%.

Since commercial tin oxide normally has a particle size of less than 1 μm in a proportion amounting to more than 70 wt-%, it is necessary to coarsen this powder. This is preferably effected by annealing the tin-oxide powder or the tin-oxide powder together with the bismuth-oxide powder at temperatures from 700° to 1400° C. until more than 60 wt-% of the tin oxide or of the mixed-oxide powder exhibits a particle size of more than 1 μm.

The use of these coarsened oxide powders produces, after sintering of the pressed articles, a material that is substantially less brittle than materials having commercial oxide-particle sizes and can therefore be deformed more easily.

DETAILED DESCRIPTION OF INVENTION

The following Examples are intended to elucidate the invention in more detail:

1. A material with the composition Ag90$SnO_2$9.4 $In_2O_3$0.4 $Bi_2O_3$0.2 was produced by annealing commercial $SnO_2$ powder, the particle sizes of which were <1 μm in a proportion amounting to 82%, in air for 20 h at 1000° C. so that the $SnO_2$ powder exhibited particle sizes of <1 μm in a proportion amounting to only 25%. These powders were mixed together with $In_2O_3$ and $Bi_2O_3$ powders and Ag powder, the particle sizes of which were <63 μm in each case. The mixture was pressed by a cold isostatic method so as to form a billet and sintered for 2 h at 750° C. The billet was then extruded to give it a profile. In a commercial switching device with a rated current of about 50 A the material achieved an operational life of 2 million switching cycles. This operational life lies clearly above that of the $AgSnO_2$ materials known hitherto. The excess temperature shows non-critical values of, on average, clearly below 100° C. 2. A material with the composition Ag88$SnO_2$11.4 $In_2O_3$0.3 $Bi_2O_3$0.3 was produced in accordance with Example 1. In a commercial switching device with a rated current of about 50 A this material also achieved an operational life of 2 million switching cycles. The excess temperature showed non-critical values of, on average, clearly below 100° C. 3. A material with the composition Ag88$SnO_2$11.4 $In_2O_3$0.3 $Bi_2O_3$0.3 was produced by mixing commercial $SnO_2$ powder, the particle sizes of which were in the class of <1 μm in a proportion amounting to 82 %, with $Bi_2O_3$ powder with particle sizes <32 μm and annealing it in air for 15 h at 1000° C. so that an $SnO_2$–$Bi_2O_3$ mixed oxide was formed with particle sizes that were in the class of <1 μm in a proportion amounting to only 20%. This powder was mixed with Ag powder with a particle size of <63 μm and $In_2O_3$ powder and pressed by a cold isostatic method so as to form a bolt. The bolt was then sintered (750° C., 2 h) and extruded to give it a profile. In a commercial switching device with a rated current of about 50 A the material achieved an operational life of over 2.2 million switching cycles. The excess temperature shows non-critical values of, on average, far below 100° C. 4. A material with the composition Ag90$SnO_2$ 8.7 $In_2O_3$ 0.5 $Bi_2O_3$ 1.6 was produced by annealing commercial $SnO_2$ powder, the particle sizes of which were in the class of <1 μm in a proportion amounting to 82%, for 60 h at 1000° C. so that the $SnO_2$ powder exhibited a particle size in the class of <1 μm in a proportion amounting to only 5%. This powder was processed further as described in Example 1. The material, the composition of which does not lie within the range in accordance with the invention, could only be processed with difficulty, and the switching life was below the values of the material according to the invention.

Further variations and modifications will be apparent to those skilled in the art and are intended to be encompassed by the claims appended hereto.

German priority application 195 03 182.2 is relied on and incorporated here in by reference.

We claim:

1. A process for the manufacture of a sintering material manufactured by powder metallurgy for use as an electrical contact, comprising mixing powders of the following components: 3.2 to 19.9 wt-% tin oxide, 0.05 to 0.4 wt-%, in each case, of indium oxide and bismuth oxide, the remainder being silver, cold isostatic pressing the powder mixture, sintering at temperatures from 500° to 940° C. and extruding so as to form wires or profiles, wherein more than 60 wt-% of the tin-oxide powder exhibits a particle size of more than 1 μm.

2. The process according to claim 1, wherein the bismuth-oxide powder is caused to react thermally with the tin-oxide powder so as to form $Bi_2Sn_2O_7$ mixed-oxide powder which exhibits a particle size of more than 1 μm in a proportion amounting to more than 60 wt-% and this mixed-oxide powder is mixed with the silver powder and the indium-oxide powder.

3. The process according to claim 1, wherein commercial tin oxide is annealed at temperatures from 700° to 1400° C. until more than 60 wt-% of the powder exhibits a particle size of more than 1 μm.

4. The process according to claim 2, wherein commercial tin oxide is annealed together with commercial bismuth oxide at temperatures from 700° to 1400° C. until more than 60 wt-% of the mixed-oxide powder exhibits a particle size of more than 1 μm.

5. An electrical contact made by the process of claim 1.

6. An electrical contact made by the process of claim 2.

7. An electrical contact made by the process of claim 3.

8. A sintering material manufactured by powder metallurgy for use as electrical contacts, comprising 3.2 to 19.9 wt-% tin oxide, 0.05 to 4 wt-%, in each case, of indium oxide and bismuth oxide, the remainder being silver wherein more than 60 wt-% of the tin-oxide powder exhibits a particle size of more than 1 μm.

* * * * *